US008069584B2

(12) United States Patent
Wang

(10) Patent No.: US 8,069,584 B2
(45) Date of Patent: Dec. 6, 2011

(54) ANTI-STATIC SOLE

(75) Inventor: San-Huai Wang, Taichung (TW)

(73) Assignee: New Process Corp., Taichung (TW)

( * ) Notice: Subject to any disclaimer, the term of this patent is extended or adjusted under 35 U.S.C. 154(b) by 418 days.

(21) Appl. No.: 12/479,788

(22) Filed: Jun. 6, 2009

(65) Prior Publication Data

US 2010/0205833 A1 Aug. 19, 2010

(30) Foreign Application Priority Data

Feb. 13, 2009 (TW) ..... 98202127 U

(51) Int. Cl.
*A43B 23/00* (2006.01)
*A43B 13/38* (2006.01)

(52) U.S. Cl. ..... 36/25 R; 36/30 R; 36/43; 361/224

(58) Field of Classification Search ..... 36/25 R, 36/30 R, 71, 43, 44; 361/224
See application file for complete search history.

(56) References Cited

U.S. PATENT DOCUMENTS

| | | | | | |
|---|---|---|---|---|---|
| 2,857,556 | A * | 10/1958 | Price | 361/224 |
| 3,196,314 | A * | 7/1965 | Meltzer | 361/224 |
| 3,293,494 | A * | 12/1966 | Fischer | 361/224 |
| 4,366,630 | A * | 1/1983 | Bloom | 36/30 R |
| 4,689,900 | A * | 9/1987 | Ishibashi | 36/103 |
| 5,319,867 | A * | 6/1994 | Weber | 36/44 |
| 5,426,870 | A * | 6/1995 | Purnell et al. | 36/84 |
| 5,653,047 | A * | 8/1997 | Franey | 36/136 |
| 6,421,222 | B1 * | 7/2002 | Maritz et al. | 361/224 |
| 7,055,266 | B2 * | 6/2006 | Elsey | 36/30 R |
| 2007/0000155 | A1 * | 1/2007 | Laufer et al. | 36/136 |
| 2008/0022562 | A1 * | 1/2008 | Manis | 36/59 R |

* cited by examiner

*Primary Examiner* — Marie Patterson

(57) ABSTRACT

An anti-static sole is provided with a pad body between a midsole and an insole. In the pad body is provided a chip resistor. The chip resistor includes a connecting pin at each of two opposite ends thereof. The two connecting pins of the chip resistor are electrically connected to the insole and the midsole, respectively. Since the chip resistor has no exposed wires, damage to the wires is avoided. Further, the anti-static effect can be improved since the resistance of the chip resistor is stable.

16 Claims, 8 Drawing Sheets

ANTI-STATIC SOLE

BACKGROUND OF THE INVENTION

1. Field of the Invention

The present invention relates to a shoe attached with a grounding device, and more particularly to an anti-static sole.

2. Description of the Prior Art

Generally speaking, the phenomenon that charge transfer occurs when an insulator accumulated with charges is brought into contact with a conductor, or charge transfer occurs and potential difference is produced when two objects rub each other is called static electricity. The static electricity generally has no effect on the human body, but it will cause damage to precision equipments such as electronic elements or magnetic memory card. Therefore, the person who processes the electronic elements or the magnetic memory cards must clear the static charges from his body before work. Conductive shoe is one of the existing equipments for eliminating the static charges on the person.

Conventionally, the existing conductive shoe is provided with a ceramic resistor between a midsole and an insole of a sole, and the ceramic resistor is connected to the midsole and the insole, respectively to allow the static charges on the user to be conducted to the midsole through the ceramic resistor and then conducted to the ground from the midsole. By such arrangements, the static charges on the user can be partially eliminated such that the remaining static charges cannot cause any damage to the electronic elements or magnetic memory cards.

However, the ceramic resistor is made up of a middle ceramic portion and two metallic wires at both ends of the middle ceramic portion, and the connecting structures for connecting the ceramic portion and the two metallic wires are quite fragile, so that after being bent for many times or pressed for a long time, the metallic wires will be damaged or even broken, and the ceramic portion is likely to rupture due to overlarge pressure applied by the user. If the user finds the above defects, he must replace his shoes, but if the user fails to find the above defects, the static charges on the user cannot be eliminated properly, inevitably causing damage to the electronic elements or magnetic memory cards.

Hence, U.S. Pat. No. 6,421,222, entitled "PRECISION FAIL-SAFE ELECTROSTATIC DISSIPATING DEVICE", disclosed an apparatus for dissipating static charges which is constructed of several conductive layers and a set of parallel resistors, if either resistor of the parallel resistor fails, the static charges can also be dissipated through the remained resistors, ensuring fail-safe dissipation of static electricity, but it can be found that the production cost is greatly increased due to the increase of the number of the resistors.

The present invention has arisen to mitigate and/or obviate the afore-described disadvantages.

SUMMARY OF THE INVENTION

The primary objective of the present invention is to provide an anti-static sole which is provided with a chip resistor between a midsole and an insole to solve the problems of the ceramic resistor and reduce the cost.

In order to achieve the above objective, an anti-static sole in accordance with the present invention comprises a midsole, a pad body and an insole. The midsole is conductive and provided with a first conductive element which can be made of conductive fabric. The pad body has a bottom surface thereof disposed on the midsole. The pad body interiorly includes a chip resistor. The chip resistor includes a connecting pin at each of two opposite ends thereof. The two connecting pins are located at the top surface and the bottom surface of the pad body, respectively, and one of the two connecting pins is electrically connected to the first conductive element of the midsole. The insole is disposed on and cooperates with the midsole to clamp the pad body. The insole is provided with a second conductive element which can be made of conductive fabric. The second conductive element has a first portion located at the top surface of the insole and a second portion located at the bottom surface of the insole, and the second portion of the second conductive element located at the bottom surface of the insole is covered by the pad body and electrically connected to the other of the connecting pins of the chip resistor.

When the user steps on the insole, the foot of the user will contact the first portion of the second conductive element located at the top surface of the insole, so that the static charges on the user will be conducted to the chip resistor through the second conductive element and then conducted to the first conductive element from the chip resistor and finally conducted to the ground from the midsole, thus reducing the static charges on the user.

Since the ceramic resistor is replaced by the chip resistor of the present invention which utilizes two connecting pins at two ends thereof to realize electrical connection and conduction, no metallic wires are exposed, thus avoiding the damage of the resistor, and since the chip resistor is packaged, the outside frame is unneeded, thus saving cost.

The secondary objective of the present invention is to provide an anti-static shoe which is provided with a shoe upper on the anti-static sole to utilize the chip resistor on the shoe to conduct the static charges on the user who wears the anti-static shoe to the ground, and further the chip resistor is difficult to be damaged.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Referring to FIGS. 1-4, an anti-static sole in accordance with the present invention comprises a midsole 10, a pad body 20, and an insole 30.

The midsole 10 is made of conductive material and provided with a first conductive element 11. The first conductive element 11 is made of conductive fabric formed by mixed weaving of fiber and wires, so the wires can be used to conduct electricity. The first conductive element 11 is exposed from a top surface of the midsole 10.

Figure 3A:
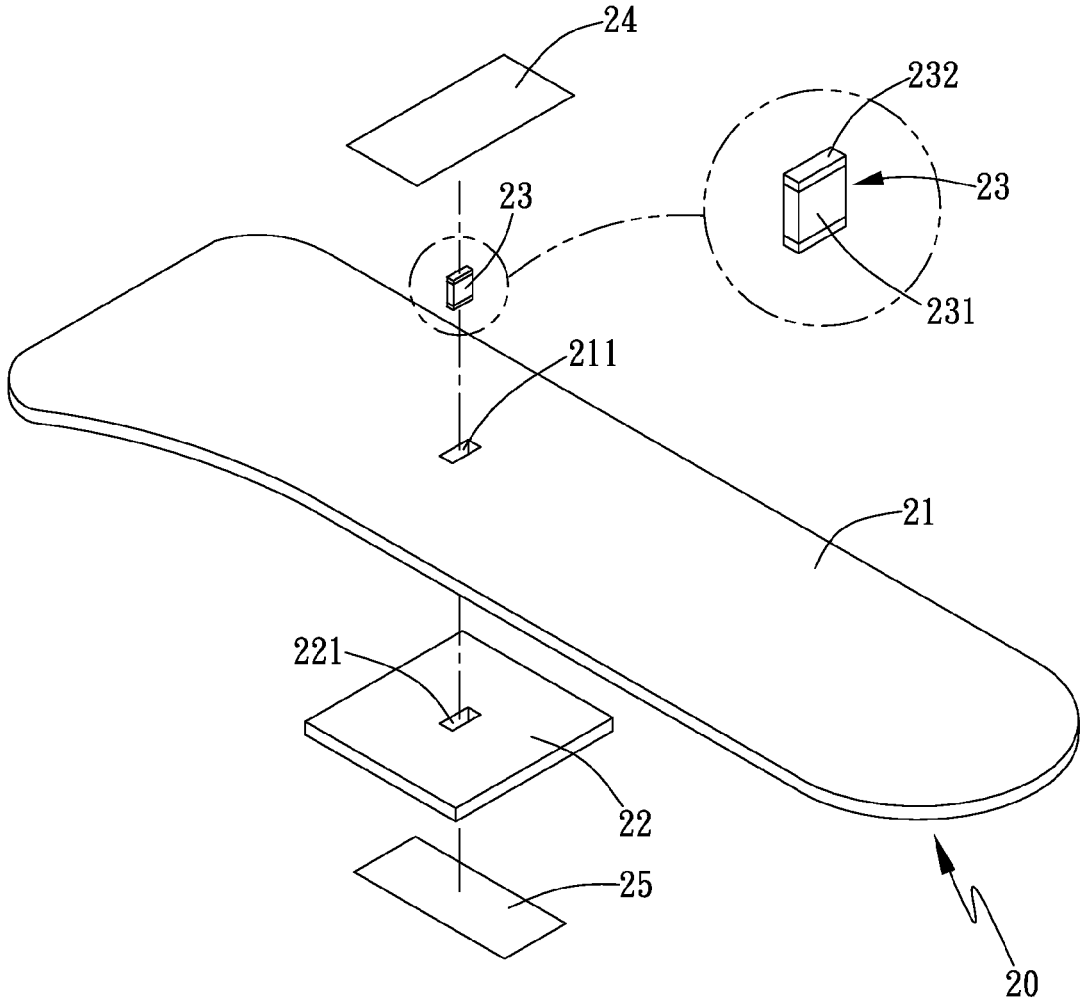
FIG. 3*a* is an exploded view of a pad body of the anti-static sole in accordance with the present invention.
Figure 3B:
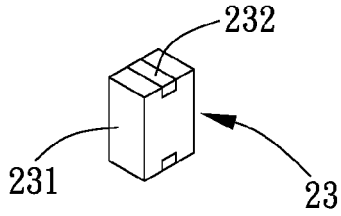
FIG. 3*b* is a perspective view showing another chip resistor for the anti-static sole in accordance with the present invention.
Figure 4:
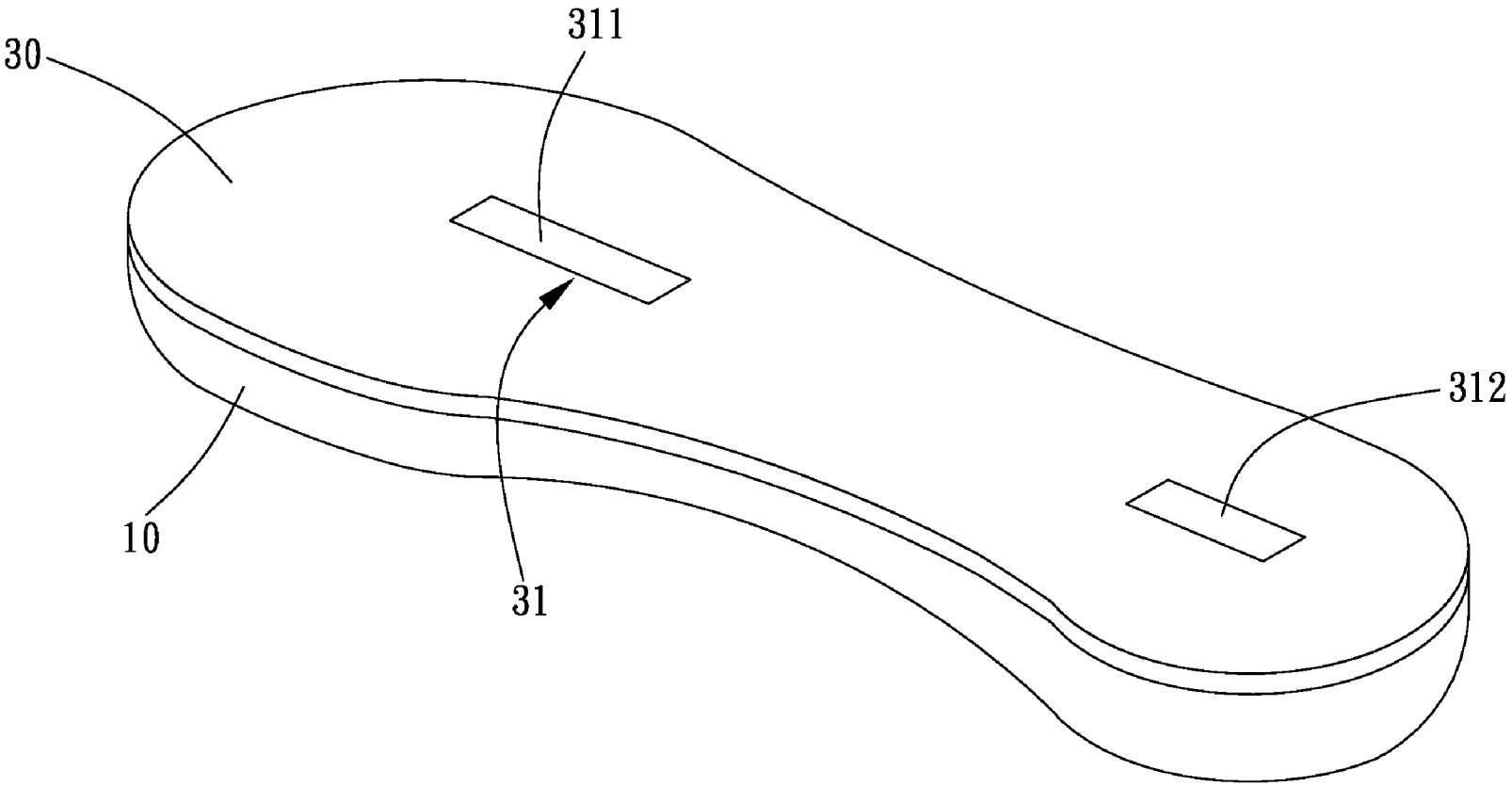
FIG. 4 is a perspective view of the anti-static sole in accordance with the present invention.

The pad body 20 has a bottom surface disposed at the top surface of the midsole 10. The pad body 20, as shown in FIG. 3*a*, includes a main pad 21, an assistant pad 22, a chip resistor 23, an upper conductive fabric 24 and a lower conductive fabric 25. The main pad 21 includes a through hole 211. The assistant pad 22 is disposed at the bottom surface of the main pad 21 and includes a receiving hole 221 in alignment with the through hole 211. The chip resistor 23 is received in both the through hole 211 and the receiving hole 221. The chip resistor 23 (commonly called SMD (surface-mount device) resistor) includes a packaging layer 231 and two connecting pins 232. The packaging layer 231 includes an inner resistive circuit, and the two connecting pins 232 are disposed at and abutted against two opposite ends of the packaging layer 231. The two connecting pins 232 are electrically connected to the resistive circuit, respectively. One of the two connecting pins 232 is exposed from the top surface of the main pad 21, and the other of the two connecting pins 232 is exposed from the bottom surface of the assistant pad 22. The upper conductive fabric 24 is disposed at the top surface of the main pad 21 and covers a corresponding connecting pin 232 of the chip resistor 23 in such a manner that the upper conductive fabric 24 is in electrical contact with this connecting pin 232. The lower conductive fabric 25 is disposed at the bottom surface of the assistant pad 22 and covers a corresponding connecting pin 232 of the chip resistor in such a manner that the lower conductive fabric 25 is in electrical contact with this connecting pin 232. The lower conductive fabric 25 is further in electrical contact with the first conductive element 11 of the midsole 10. In the present embodiment, the chip resistor 23 is a thick film chip resistor as shown in FIG. 3*a*. In addition, the chip resistor 23 of the present invention can also be a power metal film chip resistor as shown in FIG. 3*b* in another embodiment. It is to be noted that the above two resistors are described by way of example only and not limitation.

Figure 1:
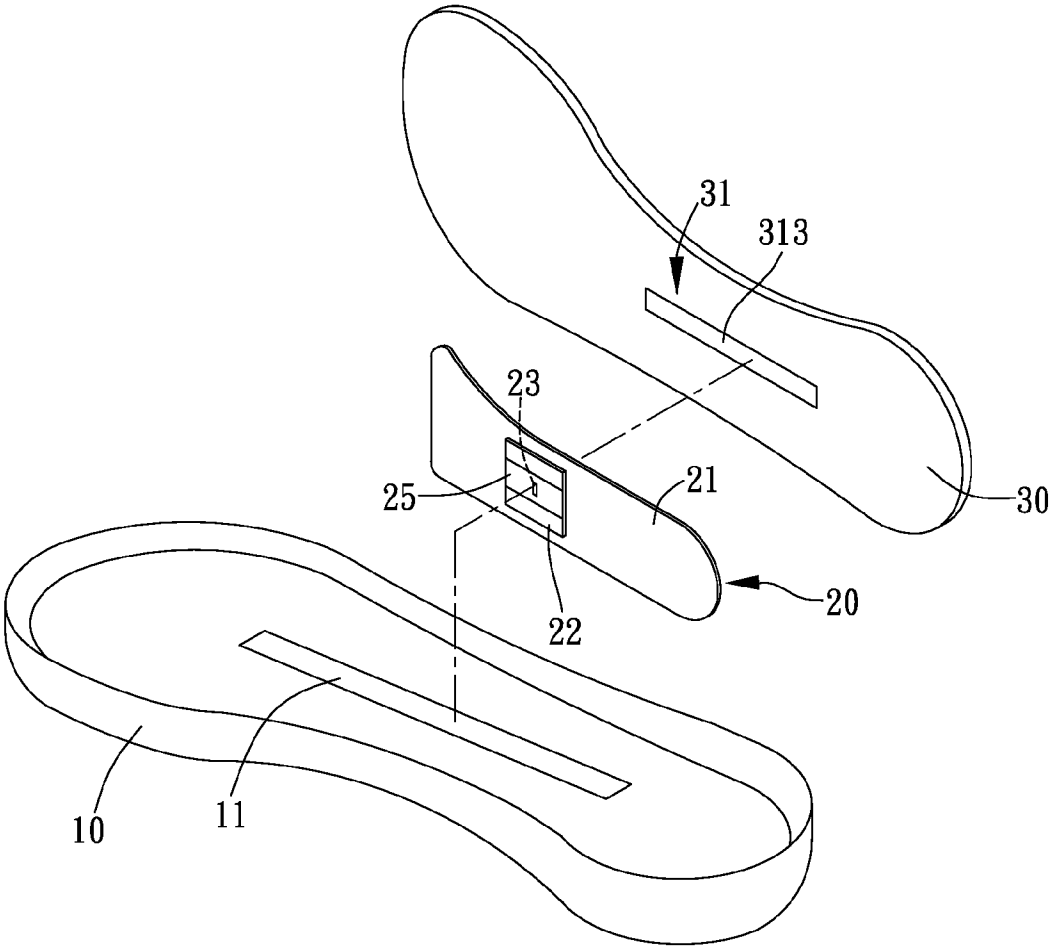
FIG. 1 is an exposed view of an anti-static sole in accordance with the present invention.
Figure 2:
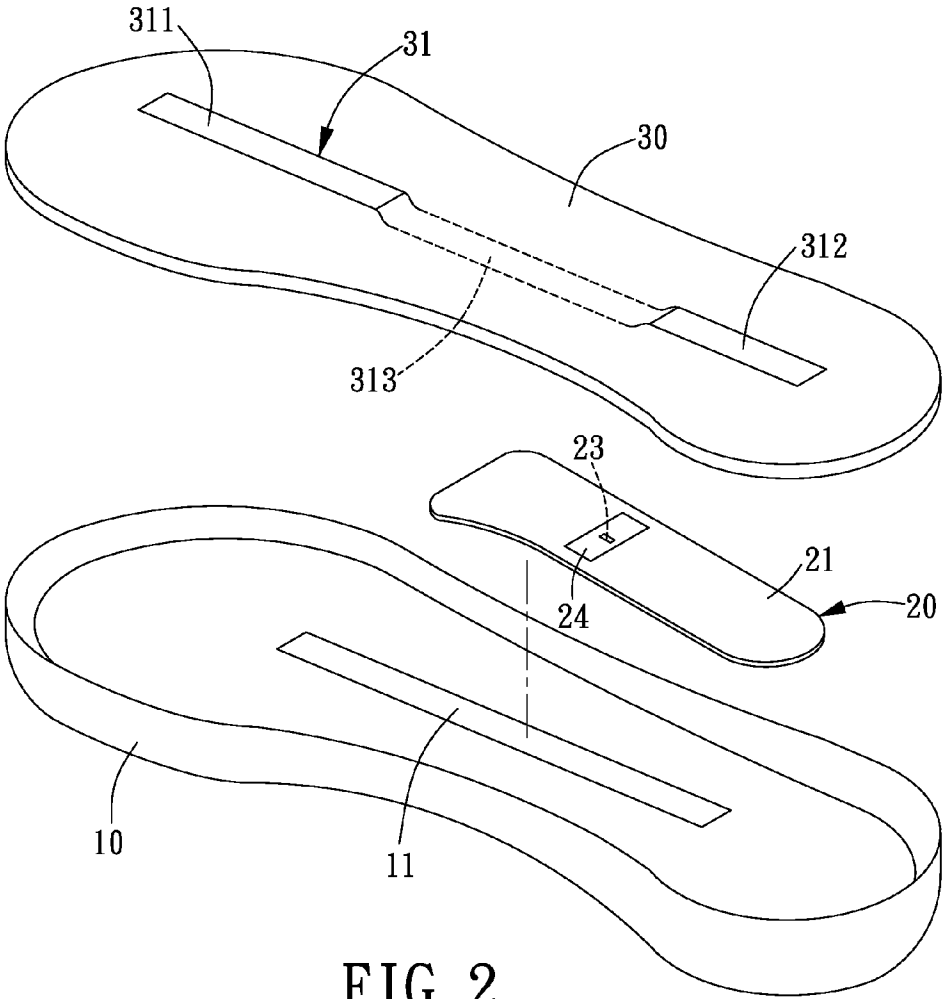
FIG. 2 is another exploded view of the anti-static sole in accordance with the present invention.
Figure 5:
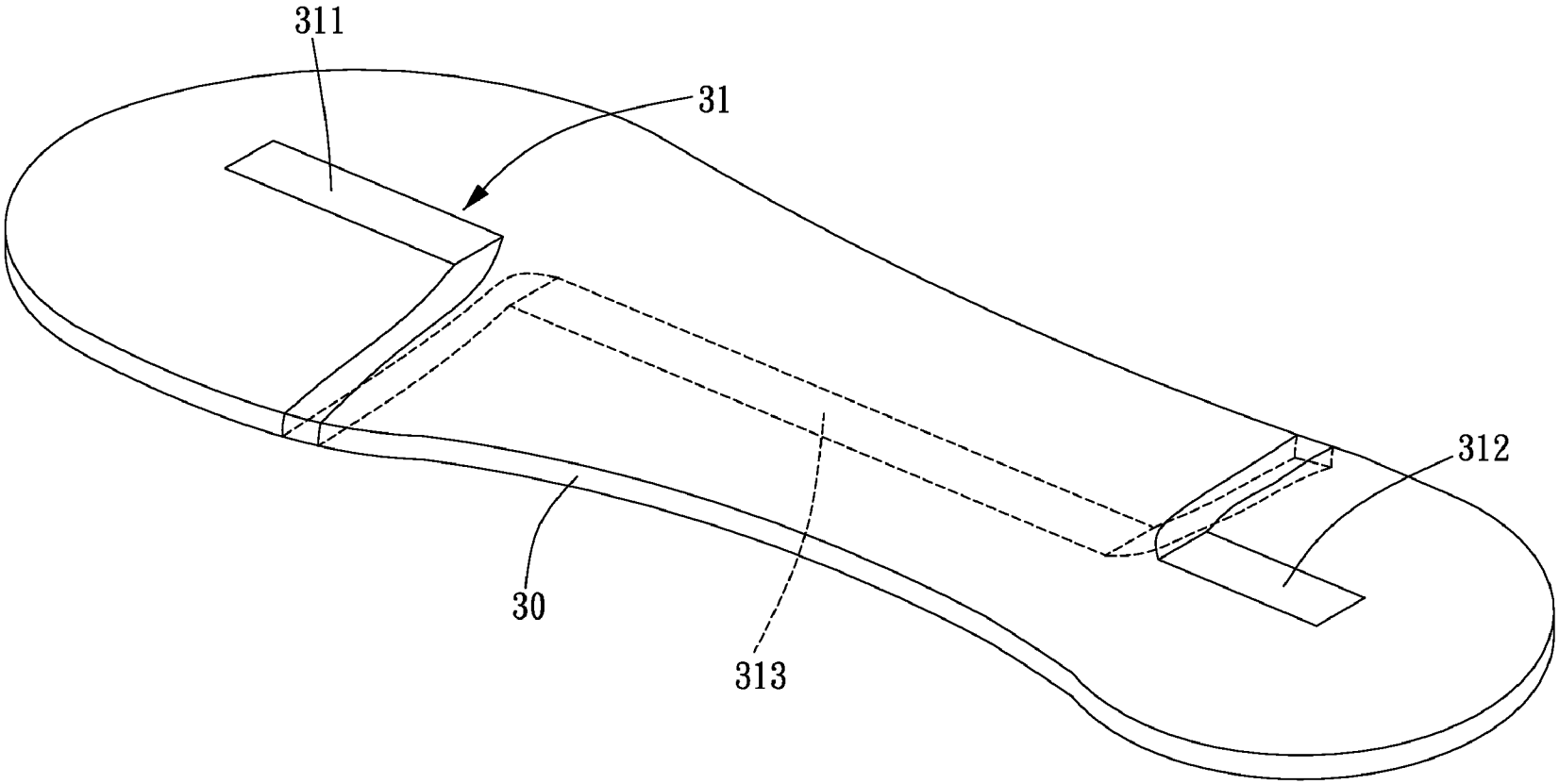
FIG. 5 is a schematic view showing another form of the second conductive element for the anti-static sole in accordance with the present invention.

The insole 30 is disposed at a top surface of the midsole 10 and cooperates with the midsole 10 to clamp the pad body 20. The insole 30 is provided with a second conductive element 31. The second conductive element 31 is made of conductive fabric and includes a first segment 311 and a second segment 312 at the top surface of the insole 30, and a third segment 313 at the bottom surface of the insole 30. The third segment 313 of the second conductive element 31 is covered by the pad body 20, so that the third segment 313 can be prevented from electrically connecting the midsole 10 or the first conductive element 11 of the midsole 10. The upper conductive fabric 24 of the pad body 20 is in electrical contact with the third segment 313 of the second conductive element 31. In the present embodiment, FIG. 2 shows that the second conductive element 31 is disposed on the insole 30 in such a manner that two ends of the second conductive element 31 penetrate to the top surface of the insole 30 from the bottom surface thereof to form the first segment 311 and the second segment 312, and the middle portion of the second conductive element 31 forms the third segment 313. Alternatively, as shown in FIG. 5, two ends of the second conductive element 31 can be wound from the bottom surface of the insole 30 to the top surface of the insole 30 in such a manner that the two ends of the second conductive element 31 can also form the first segment 311 and the second segment 312, and the middle portion of the second conductive element 31 can also form the third segment 313.

When the anti-static sole of the present invention is in use, the bottom of the foot of the user is in contact with the first segment 311 and the second segment 312 of the second conductive element 31 of the insole 30, respectively, so that the static charges on the user can be conducted to the third segment 313 through the first segment 311 and the second segment 312, and next conducted to the chip resistor 23 from the third segment 313 through the upper conductive fabric 24 and one of the connecting pins 232 of the chip resistor 23, and then conducted to the first conductive element 11 of the midsole 10 through the other of the connecting pins 232 of the chip resistor 23 and the lower conductive fabric 25, and finally conducted to the ground through the midsole 10, thus reducing the static charges on the user.

Since the ceramic resistor is replaced by the chip resistor 23, and the connecting pins 232 abutted against both ends of the chip resistor 23 are used to realize electrical connection, it can solve the problems of the ceramic resistor, such as the damage of the metallic wires and the ceramic portion, and the broken circuit. Further, the chip resistor 23 will be packaged during the production process to include the packaging layer 231 which can resist an external force and further prevent the two abutted connecting pins 232 from deformation, thus saving cost without the use of the outside frame.

Figure 6:
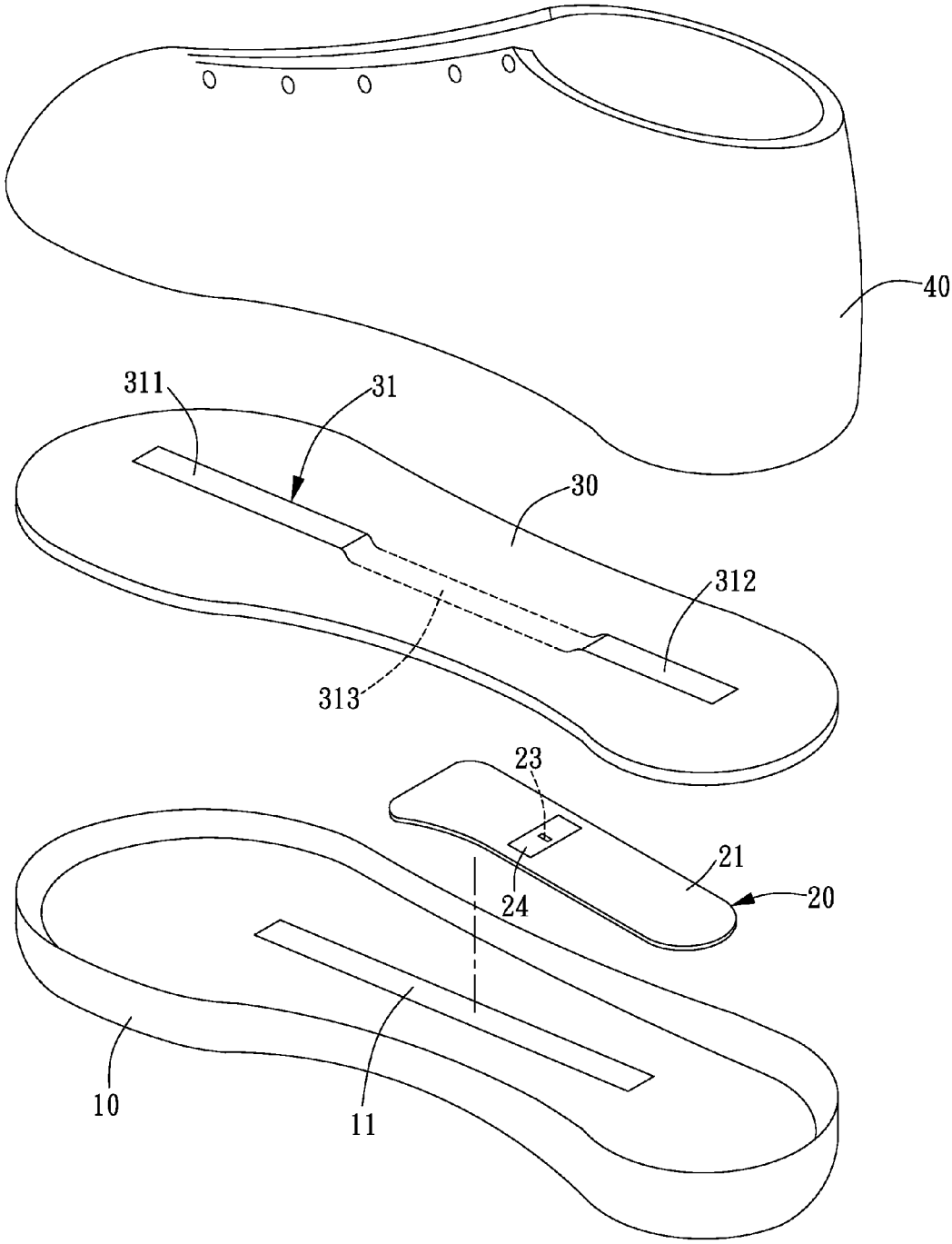
FIG. 6 is an exposed view showing that the anti-static sole in accordance with the present invention is additionally provided with a shoe upper.
Figure 7:
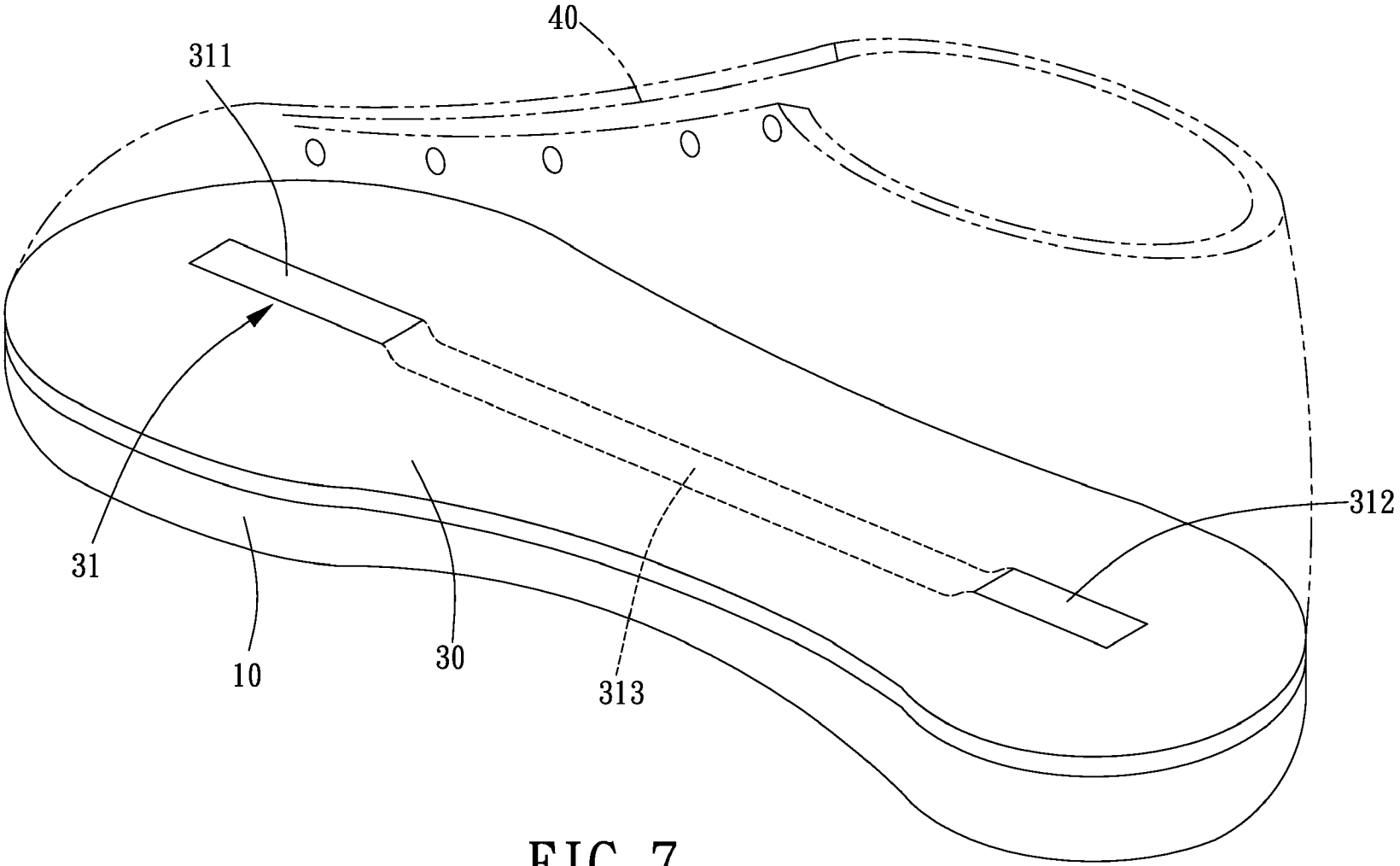
FIG. 7 is a perspective view showing that the anti-static sole in accordance with the present invention is additionally provided with a shoe upper.

Additionally, as shown in FIGS. 6 and 7, on the anti-static sole of the present invention is provided a shoe upper 40 which is connected to the top surfaces of the midsole 10 and the insole 30, respectively. The shoe upper 40 covers the insole 30 to form a shoe, so that when the user wears it, the static charges on the user can be conducted to the ground.

Figure 8:
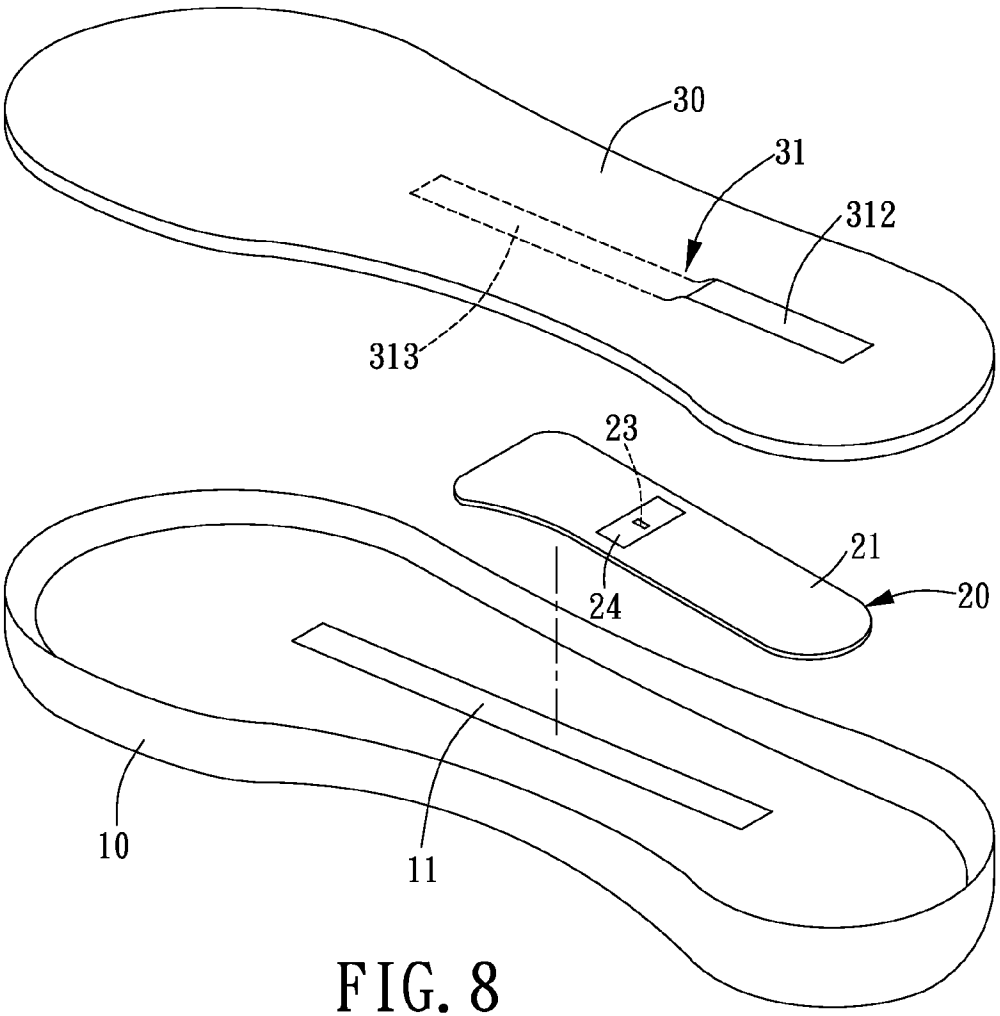
FIG. 8 is an exposed view showing that the second conductive element of the present invention includes two segments.

According to the skill of the present invention, as long as the second conductive element 31 of the present invention have two portions located at both the top surface and the bottom surface of the insole 30, and the portion of the second conductive element 31 at the bottom surface of the insole 30 is covered by the pad body 20, the second conductive can exert the same function as described above, such as shown in FIG. 8, the second conductive element 31 includes a second segment 312 located at the top surface of the insole 30 and a third segment 313 located at the bottom surface of the insole 30, and the third segment 313 of the second conductive element 31 is covered by the pad body 20, so that the static charges on the user can also be conducted to the third segment 313 through the second segment 312 and then to the first conductive element 11 from the third segment 313 through the chip resistor 23, thus finally conducting the static charges on the user to the ground.

While we have shown and described various embodiments in accordance with the present invention, it is clear to those skilled in the art that further embodiments may be made without departing from the scope of the present invention.

What is claimed is:

1. An anti-static sole comprising:

a midsole being conductive and provided with a first conductive element at a top surface thereof;

a pad body having a bottom surface disposed at the top surface of the midsole and interiorly including a chip resistor, the chip resistor including a connecting pin at each of two opposite ends thereof, the two connecting pins being respectively located at a top surface and the bottom surface of the pad body, one of the two connecting pins being electrically connected to the first conductive element of the midsole; and an insole being disposed at the top surface of the midsole and cooperating with the midsole to clamp the pad body, the insole being provided with a second conductive element, the second conductive element having a first portion located at a top surface of the insole and a second portion located at a bottom surface of the insole, the second portion of the second conductive element located at the bottom surface of the insole being covered by the pad body and electrically connected to the other of the connecting pins of the chip resistor.

2. The anti-static sole as claimed in claim 1, wherein the first conductive element and the second conductive element are both made of conductive fabric.

3. The anti-static sole as claimed in claim 1, wherein the pad body includes a main pad and the chip resistor, the main pad includes a through hole, and the chip resistor is received in the through hole.

4. The anti-static sole as claimed in claim 1, wherein the chip resistor of the pad body includes a packaging layer and the two connecting pins, the packaging layer includes an inner resistive circuit, the two connecting pins are disposed at and abutted against two opposite ends of the packaging layer, and the two connecting pins are electrically connected to the resistive circuit, respectively.

5. The anti-static sole as claimed in claim 1, wherein the pad body includes a main pad, an assistant pad, an upper conductive fabric, a lower conductive fabric and the chip resistor, the main pad includes a through hole, the assistant pad is disposed at a bottom surface of the main pad, the assistant pad includes a receiving hole, the through hole of the main pad is in alignment with the receiving hole of the assistant pad, the chip resistor is received in both the through hole and the receiving hole, one of the two connecting pins is exposed from a top surface of the main pad, and the other of the two connecting pins is exposed from a bottom surface of the assistant pad, the upper conductive fabric is disposed at the top surface of the main pad and covers a corresponding connecting pin of the chip resistor in such a manner that the upper conductive fabric is in electrical contact with this connecting pin, the lower conductive fabric is disposed at the bottom surface of the assistant pad and covers a corresponding connecting pin of the chip resistor in such a manner that the lower conductive fabric is in electrical contact with this connecting pin, the upper conductive fabric is in electrical contact with the second conductive element of the insole.

6. The anti-static sole as claimed in claim 1, wherein the second conductive element of the insole includes a first segment and a second segment at the top surface of the insole and a third segment at the bottom surface of the insole, the third segment of the second conductive element is covered by the pad body and electrically connected to a corresponding connecting pin of the chip resistor.

7. The anti-static sole as claimed in claim 6, wherein two ends of the second conductive element penetrate to the top surface of the insole from the bottom surface thereof in such a manner that the two ends of the second conductive element form the first segment and the second segment, respectively, and a middle portion of the second conductive element forms the third segment.

8. The anti-static sole as claimed in claim 6, wherein two ends of the second conductive element of the insole are wound from the bottom surface of the insole to the top surface of the insole in such a manner that the two ends of the second conductive element form the first and the second segments, respectively, and a middle portion of the second conductive element forms the third segment.

9. An anti-static shoe comprising:

a midsole being conductive and provided with a first conductive element at a top surface thereof;

a pad body having a bottom surface disposed at the top surface of the midsole and interiorly including a chip resistor, the chip resistor including a connecting pin at each of two opposite ends thereof, the two connecting pins being respectively located at a top surface and the bottom surface of the pad body, one of the two connecting pins being electrically connected to the first conductive element of the midsole;

an insole being disposed at the top surface of the midsole and cooperating with the midsole to clamp the pad body, the insole being provided with a second conductive element, the second conductive element having a first portion located at a top surface of the insole and a second portion located at a bottom surface of the insole, the second portion of the second conductive element located at the bottom surface of the insole being covered by the pad body and electrically connected to the other of the connecting pins of the chip resistor; and a shoe upper being disposed at the top surfaces of the midsole and the insole and covering the insole.

10. The anti-static shoe as claimed in claim 9, wherein the first conductive element and the second conductive element are both made of conductive fabric.

11. The anti-static shoe as claimed in claim 9, wherein the pad body includes a main pad and the chip resistor, the main pad includes a through hole, and the chip resistor is received in the through hole.

12. The anti-static shoe as claimed in claim 9, wherein the chip resistor of the pad body includes a packaging layer and the two connecting pins, the packaging layer includes an inner resistive circuit, the two connecting pins are disposed at and abutted against two opposite ends of the packaging layer, and the two connecting pins are electrically connected to the resistive circuit, respectively.

13. The anti-static shoe as claimed in claim 9, wherein the pad body includes a main pad, an assistant pad, an upper conductive fabric, a lower conductive fabric and the chip resistor, the main pad includes a through hole, the assistant pad is disposed at a bottom surface of the main pad, the assistant pad includes a receiving hole, the through hole of the main pad is in alignment with the receiving hole of the assistant pad, the chip resistor is received in both the through hole and the receiving hole, one of the two connecting pins is exposed from a top surface of the main pad, and the other of the two connecting pins is exposed from a bottom surface of the assistant pad, the upper conductive fabric is disposed at the top surface of the main pad and covers a corresponding connecting pin of the chip resistor in such a manner that the upper conductive fabric is in electrical contact with this connecting pin, the lower conductive fabric is disposed at the bottom surface of the assistant pad and covers a corresponding connecting pin of the chip resistor in such a manner that the lower conductive fabric is in electrical contact with this connecting pin, the upper conductive fabric is in electrical contact with the second conductive element of the insole.

14. The anti-static shoe as claimed in claim 9, wherein the second conductive element of the insole includes a first segment and a second segment at the top surface of the insole and a third segment at the bottom surface of the insole, the third segment of the second conductive element is covered by the pad body and electrically connected to a corresponding connecting pin of the chip resistor.

15. The anti-static shoe as claimed in claim 14, wherein two ends of the second conductive element penetrate to the top surface of the insole from the bottom surface thereof in such a manner that the two ends of the second conductive element form the first segment and the second segment, respectively, and a middle portion of the second conductive element forms the third segment.

16. The anti-static sole as claimed in claim 14, wherein two ends of the second conductive element of the insole are wound from the bottom surface of the insole to the top surface of the insole in such a manner that the two ends of the second conductive element form the first and the second segments, respectively, and a middle portion of the second conductive element forms the third segment.

* * * * *